United States Patent [19]

Gatsis

[11] Patent Number: 4,943,548

[45] Date of Patent: Jul. 24, 1990

[54] METHOD OF PREPARING A CATALYST FOR THE HYDROCONVERSION OF ASPHALTENE-CONTAINING HYDROCARBONACEOUS CHARGE STOCKS

[75] Inventor: John G. Gatsis, Des Plaines, Ill.

[73] Assignee: UOP, Des Plaines, Ill.

[21] Appl. No.: 210,943

[22] Filed: Jun. 24, 1988

[51] Int. Cl.[5] ..... B01J 31/00

[52] U.S. Cl. ..... 502/173; 502/171; 208/108; 208/112

[58] Field of Search ..... 502/171, 173; 208/108, 208/112

[56] References Cited

U.S. PATENT DOCUMENTS

| | | | |
|---|---|---|---|
| 1,251,201 | 12/1917 | Ellis | 502/173 |
| 1,378,338 | 5/1921 | Ellis | 502/173 |
| 1,876,270 | 9/1932 | Zorn . | |
| 2,067,368 | 1/1937 | Williams et al. | 502/173 |
| 2,091,831 | 8/1937 | Pongratz et al. | 208/108 |
| 3,131,142 | 4/1964 | Mills, Jr. | 208/108 |
| 3,161,585 | 12/1964 | Gleim et al. | 208/264 |
| 3,331,769 | 7/1967 | Gatsis | 208/210 |
| 3,657,111 | 4/1972 | Gleim | 208/108 |
| 4,226,742 | 10/1980 | Bearden, Jr. et al. | 252/431 |
| 4,424,110 | 1/1984 | Bearden, Sr. et al. | 208/112 |
| 4,489,172 | 12/1984 | McDaniel | 502/239 |
| 4,557,821 | 12/1985 | Lopez et al. | 208/143 |
| 4,579,646 | 4/1986 | Grosboll et al. | 208/108 |
| 4,592,827 | 6/1986 | Galiasso et al. | 208/112 |
| 4,604,189 | 8/1986 | Derbyshire et al. | 208/111 |
| 4,719,002 | 1/1988 | Mayer et al. | 208/112 |
| 4,750,985 | 6/1988 | Aldridge et al. | 208/112 |
| 4,762,607 | 8/1988 | Aldridge et al. | 208/112 |
| 4,765,882 | 8/1988 | Aldridge et al. | 208/112 |
| 4,770,764 | 9/1988 | Ohtake et al. | 208/112 |

*Primary Examiner*—Patrick P. Garvin
*Assistant Examiner*—E. D. Irzinski
*Attorney, Agent, or Firm*—Thomas K. McBride; John G. Tolomei; John G. Cutts, Jr.

[57] ABSTRACT

A catalyst prepared by the steps which comprise: (a) adding to an asphaltene-containing hydrocarbonaceous oil charge stock an oil-insoluble metal compound and a low molecular weight alcohol; (b) converting the oil-insoluble metal compound within the charge stock by heating the oil to a temperature from about 120° F. (43° C.) to about 450° F. (232° C.) to produce an organometallic compound within the charge stock; and (c) converting the organometallic compound within the charge stock by reacting under hydroconversion conditions to produce the catalyst.

16 Claims, No Drawings

METHOD OF PREPARING A CATALYST FOR THE HYDROCONVERSION OF ASPHALTENE-CONTAINING HYDROCARBONACEOUS CHARGE STOCKS

BACKGROUND OF THE INVENTION

The field of art to which this invention pertains is the preparation of a catalyst for the hydroconversion of asphaltene-containing hydrocarbonaceous charge stocks. More specifically, the invention relates to a catalyst prepared by the steps which comprise: (a) adding to an asphaltene-containing hydrocarbonaceous oil charge stock an oil-insoluble metal compound and a low molecular weight alcohol; (b) converting the oil-insoluble metal compound within the charge stock by heating the oil to a temperature from about 120° F. (43° C.) to about 450° F. (232° C.) to produce an organometallic compound within the charge stock; and (c) converting the organometallic compound within the charge stock by reacting under hydroconversion conditions to produce the catalyst.

INFORMATION DISCLOSURE

Hydrorefining processes utilizing dispersed catalysts in admixture with a hydrocarbonaceous oil are well known. The term "hydrorefining" is intended herein to designate a catalytic treatment, in the presence of hydrogen, of a hydrocarbonaceous oil to upgrade the oil by eliminating or reducing the concentration of contaminants in the oil such as sulfur compounds, nitrogenous compounds, metal contaminants and/or to convert at least a portion of the heavy constituents of the oil such as pentane-insoluble asphaltenes or coke precursors to lower boiling hydrocarbon products, and to reduce the Conradson carbon residue of the oil.

U.S. Pat. No. 3,161,585 (Gleim et al) discloses a hydrorefining process in which a petroleum oil charge stock containing a colloidally dispersed catalyst selected from the group consisting of a metal of Groups VB and VIB, an oxide of said metal and a sulfide of said metal is reacted with hydrogen at hydrorefining conditions. This patent teaches that the concentration of the dispersed catalyst calculated as the elemental metal, in the oil charge stock is from about 0.1 weight percent to about 10 weight percent of the initial charge stock.

U.S. Pat. No. 3,331,769 (Gatsis) discloses a hydrorefining process in which a metal component (Group VB, Group VIB and iron group metals) colloidally dispersed in a hydrocarbonaceous oil is reacted in contact with a fixed bed of a conventional supported hydrodesulfurization catalyst in the hydrorefining zone. The concentration of the dispersed metal component which is used in the hydrorefining stage in combination with the supported catalyst ranges from 250 to 2500 weight parts per million (wppm).

U.S. Pat. No. 3,657,111 (Gleim) discloses a process for hydrorefining an asphaltene-containing hydrocarbon charge stock which comprises dissolving in the charge stock a hydrocarbon-soluble oxovanadate salt and forming a colloidally dispersed vanadium sulfide in situ within the charge stock by reacting the resulting solution, at hydrorefining conditions, with hydrogen and hydrogen sulfide.

U.S. Pat. No. 3,131,142 (Mills) discloses a slurry hydrocracking process in which an oil soluble dispersible compound of Groups IV–VIII is added to a heavy oil feed. The catalyst is used in amounts ranging from about 0.1 to 1 weight percent, calculated as the metal, based on the oil feed.

U.S. Pat. No. 1,876,270 (Zorn) discloses the use of oil soluble organometallic compounds in thermal cracking or in destructive hydrogenation (hydrocracking) of hydrocarbons to lower boiling products.

U.S. Pat. No. 2,091,831 (Pongratz et al) discloses cracking or destructive hydrogenation carried out in the presence of oil soluble salts of acid organic compounds selected from the group consisting of carboxylic acids and phenols with a metal of Group VI and Group VIII of the Periodic Table. The oil soluble salt is used in amounts between 4 and 20 weight percent based on the feed.

U.S. Pat. No. 4,226,742 (Bearden et al) discloses the addition of a minor amount (i.e., less than 1,000 wppm) of an oil-soluble compound of metals of Group IVB, VB, VIB, VIIB and VIII of the Periodic Table of Elements and their conversion products in the oil yield catalysts which are effective in a minor amount for the hydroconversion of hydrocarbonaceous oils.

The term "hydroconversion" is used herein to designate a catalytic process conducted in the presence of hydrogen in which at least a portion of the heavy constituents and coke precursors (as measured by Conradson carbon residue) of the hydrocarbonaceous oil is converted to lower boiling hydrocarbon products while simultaneously reducing the concentration of nitrogenous compounds, sulfur compounds and metallic contaminants.

BRIEF SUMMARY OF THE INVENTION

The invention provides a method for preparing a catalyst from organometallic compounds. A preferred use of the organometallic compounds is to produce high activity catalysts for utilization in slurry catalyst processes for hydrorefining heavy, asphaltene-containing hydrocarbonaceous liquids including petroleum crude oil and fractions therefrom, syncrudes, tar sand oils, shale oils, coal oils and for converting solid carbonaceous materials such as coal and oil shale into liquid products. An important element of the method of the present invention is the discovery that an oil-insoluble metal compound may be successfully converted into an organometallic compound by means of the addition of a low molecular weight alcohol.

One embodiment of the invention may be characterized as a catalyst prepared by the steps which comprise: (a) adding to an asphaltene-containing hydrocarbonaceous oil charge stock an oil-insoluble metal compound and a low molecular weight alcohol; (b) converting the oil-insoluble metal compound within the charge stock by heating the oil to a temperature from about 120° F. (43° C.) to about 450° F. (232° C.) to produce an organometallic compound within the charge stock; and (c) converting the organometallic compound within the charge stock by reacting under hydroconversion conditions to produce the catalyst.

Another embodiment of the invention may be characterized as a catalyst prepared by the steps which comprise: (a) adding to an asphaltene-containing hydrocarbonaceous oil charge stock an oil-insoluble metal compound and a low molecular weight alcohol; (b) converting the oil-insoluble metal compound within the charge stock by heating the oil to a temperature from about 120° F. (43° C.) to about 450° F. (232° C.) to produce an organometallic compound within the charge stock; (c)

converting the organometallic compound within the charge stock by reacting under hydroconversion conditions including a temperature from about 500° F. (260° C.) to about 1000° F. (538° C.) in a hydroconversion zone to produce a hydroconversion zone effluent comprising a hydroconverted oil and a catalyst; and (d) separating the catalyst from the hydroconversion zone effluent.

Yet another embodiment of the invention may be characterized as a catalyst prepared by the steps which comprise: (a) adding to an asphaltene-containing hydrocarbonaceous oil charge stock an oil-insoluble metal compound and a low molecular weight alcohol; (b) converting the oil-insoluble metal compound within the charge stock by heating the oil to a temperature from about 120° F. (43° C.) to about 450° F. (232° C.) to produce an organometallic compound within the charge stock; (c) converting the organometallic compound within the charge stock by reacting under hydroconversion conditions including a temperature from about 500° F. (260° C.) to about 1000° F. (538° C.) in a hydroconversion zone to produce a hydroconversion zone effluent comprising a hydroconverted oil and a catalyst; (d) separating the catalyst from the hydroconversion zone effluent; and (e) recycling at least a portion of the catalyst from step (d) to the hydroconversion zone.

Other embodiments of the present invention encompass further details such as exemplification of oilinsoluble metal compounds, types of asphaltene-containing hydrocarbonaceous oil charge stocks, organometallic compound preparation conditions, and hydroconversion conditions, all of which are hereinafter disclosed in the following discussion of each of these facets of the invention.

DETAILED DESCRIPTION OF THE INVENTION

The method of preparation of the present invention is primarily used to produce high activity catalysts for utilization in slurry processes for hydrorefining heavy asphaltene-containing hydrocarbonaceous liquids.

Suitable heavy asphaltene-containing hydrocarbonaceous oil charge stocks include whole or topped petroleum crude oils, including heavy crude oils, residual oils such as petroleum atmospheric distillation tower resid (boiling above about 650° F./343° C.) and petroleum vacuum distillation tower resid (boiling above about 1050° F./565° C.); tars; bitumen; tar sand oils, coal oils and shale oils. Particularly well suited asphaltenecontaining hydrocarbonaceous oils generally contain metallic contaminants (such as nickel, iron, and vanadium, for example, a high content of sulfur compounds, nitrogen compounds and a high Conradson carbon residue. The metal content of such oils may range up to 2,000 wppm or more and the sulfur content may range up to 5 weight percent or more. The gravity of such feeds may range from about −5° API to about +35 API and the Conradson carbon residue of the heavy feeds will generally be at least about 5 weight percent, more preferably from about 10 to about 50 weight percent. Preferably, the heavy hydrocarbonaceous oil possesses at least 10 weight percent boiling above about 1050° F. (565° C.) at atmospheric pressure, more preferably having at least about 25 weight percent boiling above 1050° F. at atmospheric pressure.

In accordance with the present invention, an oil insoluble metal compound is added to heavy asphaltenecontaining hydrocarbonaceous oil, wherein the metal is selected from the group consisting of Groups IVB, VB, VIB, VIIB, VIII and mixtures thereof of the Periodic Table of Elements. Previously, the prior art has taught that oil solubility is essential for catalyst precursors used in forming effective, solid, non-colloidal catalyst. I have unexpectedly discovered that oil insoluble metal compounds may now be successfully employed to prepare high activity catalyst when a low molecular weight alcohol is added to the charge stock containing an oil insoluble metal compound and heated to convert the oil insoluble metal compound to an organometallic compound.

The metal constituent of the oil insoluble metal compound that is convertible to a solid, non-colloidal catalyst is selected from the group consisting of Groups IVB, VB, VIB, VIIB and VIII and mixtures thereof of the Periodic Table of Elements, in accordance with the Table published by E.H. Sargent and Company, Copyright 1962, Dyna Slide Company, that is, titanium, zirconium, vanadium, niobium, tantalum, chromium, molybdenum, tungsten, manganese, rhenium, iron, cobalt, nickel and the noble metals including platinum, iridium, palladium, osmium, ruthenium and rhodium. The preferred metal constituent of the oil insoluble metal compound is selected from the group consisting of molybdenum, vanadium and chromium. Suitable oil insoluble metal compounds which may be utilized in the present invention include molybdenum trioxide and vanadium pentoxide, for example.

When the oil insoluble metal compound is added to the heavy, asphaltene-containing hydrocarbonaceous oil in the presence of the selected low molecular weight alcohol, under pretreatment conditions hereindescribed, the metal compound is converted to an organometallic compound and under hydroconversion conditions herein described is converted to an active catalyst comprising from about 0.01 to about 2 weight percent, preferably from about 0.1 to about 0.5 weight percent of the same metal or metals or the metal or metals added as oil insoluble compounds, calculated as the elemental metal, based on the heavy, asphaltene-containing hydrocarbonaceous oil.

The low molecular weight alcohol preferably possesses a molecular weight less than about 90 and may be methanol, propanol, isopropanol, butanol, for example.

In accordance with the present invention, the oil insoluble metal compound in the hydrocarbonaceous oil is converted to an organometallic compound by heating the admixture of oil insoluble metal compound, hydrocarbonaceous oil and low molecular weight alcohol to a temperature from about 120° F. (43° C.) to about 450° F. (232° C.) for a duration from about 30 minutes to about 24 hours.

The resulting organometallic compound is thereby associated with the heavy, asphaltene-containing hydrocarbonaceous oil and may be subsequently utilized in a hydroconversion zone which is maintained at a temperature ranging from about 650° F. (343° C.) to about 1000° F. (538° C.) and at a hydrogen partial pressure ranging from about 500 psig (3448 kPa gauge) to about 5000 psig (34480 kPa gauge). Contact of the organometallic compound with hydrocarbonaceous oil under the hydroconversion conditions in a reaction zone with the hydrogen-containing gas produces the catalyst and a hydroconverted oil. The hydroconverted oil containing catalyst is removed from the hydroconversion reaction zone and the catalyst may be separated from the hydroconverted oil by conventional means, for example, by settling, centrifuging or filtration of the slurry. At least a portion of the separated catalyst concentrate may be recycled directly to the hydroconversion zone or recycled to the hydrocarbonaceous oil charge stock. The space velocity, defined as volumes of oil feed per hour per volume of reactor (V/hr/V) may vary widely depending on the desired hydroconversion level. Suitable space velocities may range broadly from about 0.1 to about 10 volumes of oil feed per hour per volume of reactor. The hydroconversion process utilizing the high activity catalyst may be conducted either as a batch or as a continuous type operation.

The following example is presented for the purpose of further illustrating the process of the present invention, and to indicate the benefits afforded by the utilization thereof.

EXAMPLE

A portion of heavy Arabian vacuum column resid weighing 405 mass units and having the characteristics presented in Table 1 was admixed with 520 mass units of toluene, 20 mass units of ammonium vanadate ($NH_4VO_3$) and 225 mass units of isopropyl alcohol.

TABLE 1

| ANALYSIS OF HEAVY ARABIAN VACUUM COLUMN RESID | |
|---|---|
| Specific Gravity @ 60° F. (15.6° C.) | 1.036 |
| Heptane Insolubles, weight percent | 13.9 |
| Sulfur, weight percent | 5.35 |
| Nitrogen, weight percent | 0.43 |
| Nickel, wppm | 49 |
| Vanadium, wppm | 169 |

The resulting admixture was refluxed for 24 hours at a temperature of about 230° F. (110° C.) to produce 397 mass units of organometallic containing hydrocarbonaceous oil and possessing 4110 wppm vanadium.

A portion of the hereinabove prepared organometallic containing hydrocarbonaceous oil in an amount of 333 mass units was introduced into an autoclave which was pressured to 100 atmospheres with a hydrogen-rich gas containing 10 volume percent hydrogen sulfide. The pressurized autoclave was heated to 830° F. (443° C.) and maintained at a pressure of 200 atmospheres with hydrogen for one hour. After the autoclave was cooled and depressured, a liquid hydrocarbonaceous product was recovered and analyses indicated that 84.6 weight percent of the heptane insolubles had been converted.

The foregoing description and example clearly illustrate the advantages encompassed by the process of the present invention and benefits to be afforded with the use thereof.

I claim as my invention:

1. A method for the preparation of a catalyst which method comprises the following steps:

(a) adding to an asphaltene-containing hydrocarbonaceous oil charge stock an oil-insoluble metal compound and a low molecular weight alcohol;

(b) converting said oil-insoluble metal compound within said charge stock by heating said oil to a temperature from about 120° F. (43° C.) to about 450° F. (232° C.) to produce an organometallic compound within said charge stock; and (c) converting said organometallic compound within said charge stock by reacting under hydroconversion conditions including a temperature from about 650° F. (343° C.) to about 1000° F. (538° C.), a hydrogen partial pressure from about 500 psig (3448 kPa gauge) to about 5000 psig (36480 KPa gauge) and a space velocity from about 0.1 to about 10 volumes of oil feed per hour per volume of reactor to produce said catalyst.

2. The catalyst of claim 1 wherein said oilinsoluble metal compound contains a metal selected from the group consisting of Groups IVB, VB, VIB, VIIB and VIII of the Periodic Table of Elements and mixtures thereof.

3. The catalyst of claim 1 wherein said oilinsoluble metal compound is present in an amount from about 0.01 to about 2 weight percent calculated as the elemental metal, based on said charge stock.

4. The catalyst of claim 1 wherein said low molecular weight alcohol is selected from the group consisting of methanol, propanol, isopropanol and butanol.

5. The catalyst of claim 1 wherein said low molecular weight alcohol is present in an amount from about 0.5 to about 100 weight percent based on said charge stock.

6. The catalyst of claim 1 wherein said organometallic compound is converted to said catalyst in the presence of a gas containing hydrogen and hydrogen sulfide.

7. The catalyst of claim 1 wherein said asphaltene-containing hydrocarbonaceous oil charge stock is derived from the group consisting of petroleum, coal, tar sand and oil shale.

8. A method for the preparation of a catalyst which method comprises the following steps:

(a) adding to an asphaltene-containing hydrocarbonaceous oil charge stock an oil-insoluble metal compound and a low molecular weight alcohol;

(b) converting said oil-insoluble metal compound within said charge stock by heating said oil to a temperature from about 120° F. (43° C.) to about 450° F. (232° C.) to produce an organometallic compound within said charge stock;

(c) converting said organometallic compound within said charge stock by reacting under hydroconversion conditions including a temperature from about 500° F. (260° C.) to about 1000° F. (538° C.) in a hydroconversion zone to produce a hydroconversion zone effluent comprising a hydroconverted oil and a catalyst; and (d) separating said catalyst from said hydroconversion zone effluent.

9. The catalyst of claim 8 wherein said oilinsoluble metal compound contains a metal selected from the group consisting of Groups IVB, VB, VIB, VIIB and VIII of the Periodic Table of Elements and mixtures thereof.

10. The catalyst of claim 8 wherein said oilinsoluble metal compound is present in an amount from about 0.01 to about 2 weight percent calculated as the elemental metal, based on said charge stock.

11. The catalyst of claim 8 wherein said low molecular weight alcohol is selected from the group consisting of methanol, propanol, isopropanol and butanol.

12. The catalyst of claim 8 wherein said low molecular weight alcohol is present in an amount from about 0.5 to about 100 weight percent based on said charge stock.

13. The catalyst of claim 8 wherein said organometallic compound is converted to said catalyst in the presence of a gas containing hydrogen and hydrogen sulfide.

14. The catalyst of claim 8 wherein said asphaltene-containing hydrocarbonaceous oil charge stock is derived from the group consisting of petroleum, coal, tar sand and oil shale.

15. The catalyst of claim 8 wherein said hydroconversion conditions include a temperature from about 650° F. (343° C.) to about 1000° F. (538° C.), a hydrogen partial pressure from about 500 psig (3448 kPa gauge) to about 5000 psig (36480 kPa gauge) and a space velocity from about 0.1 to about 10 volumes of oil feed per hour per volume of reactor.

16. A method for the preparation of a catalyst which method comprises the following steps:

(a) adding to an asphaltene-containing hydrocarbonaceous oil charge stock an oil-insoluble metal compound and a low molecular weight alcohol;

(b) converting said oil-insoluble metal compound within said charge stock by heating said oil to a temperature from about 120° F. (43° C.) to about 450° F. (232° C.) to produce an organometallic compound within said charge stock;

(c) converting said organometallic compound within said charge stock by reacting under hydroconversion conditions including a temperature from about 500° F. (260° C.) to about 1000° F. (538° C.) in a hydroconversion zone to produce a hydroconversion zone effluent comprising a hydroconverted oil and a catalyst;

(d) separating said catalyst from said hydroconversion zone effluent; and (e) recycling at least a portion of said catalyst from step (d) to said hydroconversion zone.

* * * * *